US010413775B2

(12) United States Patent
Kasner et al.

(10) Patent No.: US 10,413,775 B2
(45) Date of Patent: Sep. 17, 2019

(54) FOOT HARNESS FOR RESISTANCE EXERCISE

(71) Applicants: Matthew Allan Kasner, Marina Del Rey, CA (US); Joshua Eric Dubin, Marina Del Rey, CA (US)

(72) Inventors: Matthew Allan Kasner, Marina Del Rey, CA (US); Joshua Eric Dubin, Marina Del Rey, CA (US)

( * ) Notice: Subject to any disclaimer, the term of this patent is extended or adjusted under 35 U.S.C. 154(b) by 0 days.

(21) Appl. No.: 15/847,386

(22) Filed: Dec. 19, 2017

(65) Prior Publication Data

US 2019/0184224 A1 Jun. 20, 2019

Related U.S. Application Data

(63) Continuation-in-part of application No. 14/993,951, filed on Jan. 12, 2016, now abandoned.

(60) Provisional application No. 62/129,786, filed on Mar. 7, 2015.

(51) Int. Cl.

| | |
|---|---|
| ***A63B 21/055*** | (2006.01) |
| ***A63B 71/06*** | (2006.01) |
| ***A63B 23/035*** | (2006.01) |
| ***A63B 21/04*** | (2006.01) |
| ***A63B 21/00*** | (2006.01) |

(52) U.S. Cl.

CPC ..... *A63B 21/4034* (2015.10); *A63B 21/0442* (2013.01); *A63B 21/0557* (2013.01); *A63B 23/0355* (2013.01); *A63B 71/0622* (2013.01); *A63B 2071/0694* (2013.01); *A63B 2225/09* (2013.01)

(58) Field of Classification Search

None

See application file for complete search history.

(56) References Cited

U.S. PATENT DOCUMENTS

| | | | | |
|---|---|---|---|---|
| 3,256,015 | A * | 6/1966 | Perrin | A63B 21/04 24/129 C |
| 4,393,522 | A * | 7/1983 | Calabrese | A41F 17/00 2/232 |
| 5,020,525 | A * | 6/1991 | Ewing | A61F 5/04 602/27 |
| 5,244,233 | A * | 9/1993 | McCraney | A43B 1/0036 132/200 |
| 5,558,609 | A * | 9/1996 | Olschansky | A63B 21/0552 482/122 |
| 6,390,957 | B1 * | 5/2002 | Knight | A63B 23/08 482/121 |

(Continued)

*Primary Examiner* — Stephen R Crow

(74) *Attorney, Agent, or Firm* — Hankin Patent Law, APC; Kevin Schraven; Anooj Patel

(57) ABSTRACT

A foot harness for resistance exercises. The foot harness may comprise: a top strap, a bottom strap, a heel strap, and one or more attachment points. A first end of the top strap, first end of the bottom strap, and first end of the heel strap may be coupled to one another at a first juncture region. A second end of the top strap, second end of the bottom strap, and second end of the heel strap may be coupled to one another at a second juncture region. The top strap may be adapted to engage with an upper portion of a shoe. The bottom strap may be adapted to engage with a bottom portion of the shoe. The heel strap may be adapted to engage with a rear portion of the shoe. The attachment points may be disposed at the first juncture region and the second juncture region.

8 Claims, 11 Drawing Sheets

(56) References Cited

U.S. PATENT DOCUMENTS

| | | | | |
|---|---|---|---|---|
| 8,845,568 | B2 * | 9/2014 | Clark | A61F 5/3776 602/32 |
| 9,017,235 | B2 * | 4/2015 | Khademi | A63B 21/0557 482/121 |
| 9,259,605 | B1 * | 2/2016 | Puig | A63B 7/00 |
| 2010/0274163 | A1 * | 10/2010 | Terrio | A61H 1/0266 601/27 |
| 2010/0317495 | A1 * | 12/2010 | DiGiovanni | A63B 21/0552 482/129 |
| 2013/0303344 | A1 * | 11/2013 | Rasnake | A63B 21/02 482/124 |
| 2015/0031511 | A1 * | 1/2015 | Matthews | A63B 21/0557 482/124 |
| 2016/0101309 | A1 * | 4/2016 | Schreiber | A61F 5/0127 482/124 |
| 2016/0256732 | A1 * | 9/2016 | Kasner | A63B 21/4015 |
| 2016/0296787 | A1 * | 10/2016 | Kamins | A63B 21/4013 |

* cited by examiner

FOOT HARNESS FOR RESISTANCE EXERCISE

CROSS-REFERENCE TO RELATED APPLICATIONS

This U.S. Non-Provisional Patent Application is a continuation-in-part Application of U.S. Non-Provisional patent application Ser. No. 14/993,951, filed on Jan. 12, 2016, titled "Foot Harness For Resistance Exercise", by co-inventors Matthew Allan Kasner and Joshua Eric Dubin, the contents of which are expressly incorporated herein by this reference and to which priority is claimed. U.S. Non-Provisional patent application Ser. No. 14/993,951 claims the benefit of U.S. Provisional Patent Application No. 62/129,786, filed on Mar. 7, 2015, titled "Resistance Band to Foot Attachment System", by co-inventors Matthew Allan Kasner and Joshua Eric Dubin, the contents of which are expressly incorporated herein by this reference and to which priority is claimed.

FIELD OF USE

The present disclosure relates generally to the field of physical fitness, exercise, physical therapy, rehabilitation, and weight loss devices, and more specifically, to fitness devices capable of being used anytime and anywhere for strengthening, repairing, rehabilitating, growing, increasing body muscle flexibility, and/or losing weight without being within the vicinity of any stationary equipment or structure.

BACKGROUND

Various fitness devices exist for strengthening one's muscles and losing weight. Exercise resistance bands, for example, may be used to perform a variety of exercises, including weight training and resistance training. In order to utilize a resistance band for training, a user generally anchors one end of the resistance band and applies an opposing force to the other end of the resistance band, thereby causing the resistance band to extend or stretch. The elastic property of the resistance band can be used to offer the user varying degrees of resistance needed for weight training and resistance training.

When anchoring the resistance band, the resistance band is generally attached to other heavy, bulky, immobile gym equipment or structure. Thus, the use of resistance bands unfortunately requires users to be within the vicinity of an unrelated stationary or static physical object for anchoring, such as a door, chair, furniture, gym station, or structure. Alternatively, a user may wear various bulky body suit components designed for attaching or anchoring the resistance band. However, such body suit components are generally bulky or may require foot covering over bare feet for leg exercises.

Therefore, based on the foregoing, there is a need for a new and improved exercise device for anchoring a resistance band. Preferably, the new and improved exercise device will relieve the user from being confined within the vicinity of stationary object, furniture, or structure. The new and improved exercise device will also provide a mechanism to release the need from removing shoes or wearing bulky ankle high foot enclosure. The new and improved exercise device, will preferably enable the user to engage in a full body workout to exercise, strengthen, heal muscles, or lose weight anywhere and at any time by attaching the device to the shoe or feet of the user, as desired.

SUMMARY OF EMBODIMENTS

To minimize the limitations in the prior art, and to minimize other limitations that will become apparent upon reading and understanding the present disclosure, the present specification discloses a new and improved foot harness for resistance exercises.

One embodiment may be a foot harness for resistance exercises, comprising: a top strap; a bottom strap; a heel strap; a first D ring, which is D-shaped; and a second D ring, which is D-shaped. A first end of the top strap, a first end of the bottom strap, and a first end of the heel strap may be joined at a first juncture region. A second end of the top strap, a second end of the bottom strap, and a second end of the heel strap may be joined at a second juncture region. The top strap may be adapted to engage with an upper portion of a shoe. The bottom strap may be adapted to engage with a bottom portion of the shoe. The heel strap may be adapted to engage with a rear upper portion of the shoe. The first D ring may be disposed at the first juncture region, such that a straight portion of the first D ring is disposed within a middle portion of the first juncture region and the straight portion of the first D ring is substantially parallel to a sole of the shoe, and such that a curved portion of the first D ring is rotatable approximately 180 degrees from pointing upward to pointing downward, and such that the first D ring rests pointing downward when not engaged. The second D ring may be disposed at the second juncture region, such that a straight portion of the second D ring is disposed within a middle portion of the second juncture region and the straight portion of the second D ring is substantially parallel to a sole of the shoe, and such that a curved portion of the second D ring is rotatable approximately 180 degrees from pointing upward to pointing downward, and such that the second D ring rests pointing downward when not engaged. The first junction region and the second junction region may be positioned such that, when engaged with the shoe, they are on direct opposite sides of the shoe. The top strap may comprise: a first top strap segment, a second top strap segment, and a first strap attachment and adjustment mechanism. The first top strap segment may be longer than the second top strap segment and may be adapted to removably attach to the second top strap segment via the first strap attachment and adjustment mechanism. The first strap attachment and adjustment mechanism may be positioned adjacent to the second juncture region. The heel strap may comprise: a first heel strap segment, a second heel strap segment, and a second strap attachment and adjustment mechanism. The first heel strap segment may be shorter than the second heel strap segment and may be adapted to removably attach to the second heel strap segment via the second strap attachment and adjustment mechanism. The second strap attachment and adjustment mechanism may be positioned adjacent to the second juncture region. The first strap attachment and adjustment mechanism and second strap attachment and adjustment mechanism may adjust such that the top strap and the heel strap fit matingly on the shoe. The foot harness may further comprise: a first indicia; and a second indicia. The first strap attachment and adjustment mechanism may be a cam buckle and the second strap attachment and adjustment mechanism may be a cam buckle. The first indicia may be positioned within an inner surface of the bottom strap. The second indicia may be positioned within an inner surface of the heel strap. The first indicia and the second indicia may facilitate proper positioning of the foot with respect to the foot harness. The top strap, the bottom strap, and the heel strap may be constructed of a webbing material. A width of the top strap and a width of the heel strap may be approximately 1 inch; and the bottom strap may be non-adjustable and may have a width of approximately 1.5 inches. The foot harness may be adapted to hold and secure a fitness tracker wearable.

Another embodiment may be a foot harness for resistance exercises, comprising: a top strap; a bottom strap; a heel strap; a first D ring, which is D-shaped; a second D ring, which is D-shaped; a first indicia; and a second indicia. The first end of the top strap, a first end of the bottom strap, and a first end of the heel strap may be joined at a first juncture region. A second end of the top strap, a second end of the bottom strap, and a second end of the heel strap are joined at a second juncture region. The top strap may be adapted to engage with an upper portion of a shoe. The bottom strap may be adapted to engage with a bottom portion of the shoe. The heel strap may be adapted to engage with a rear upper portion of the shoe. The first D ring may be disposed at the first juncture region, such that a straight portion of the first D ring is disposed within a middle portion of the first juncture region and the straight portion of the first D ring is substantially parallel to a sole of the shoe, and such that a curved portion of the first D ring is rotatable approximately 180 degrees from pointing upward to pointing downward, and such that the first D ring rests pointing downward when not engaged. The second D ring may be disposed at the second juncture region, such that a straight portion of the second D ring is disposed within a middle portion of the second juncture region and the straight portion of the second D ring is substantially parallel to a sole of the, and such that a curved portion of the second D ring is rotatable approximately 180 degrees from pointing upward to pointing downward, and such that the second D ring rests pointing downward when not engaged. The first junction region and the second junction region may be positioned such that they are on direct opposite sides of the shoe. The first indicia may be positioned within an inner surface of the bottom strap. The second indicia may be positioned within an inner surface of the heel strap. The first indicia and the second indicia may facilitate proper positioning of the foot. The top strap may comprise: a first top strap segment, a second top strap segment, and a first strap attachment and adjustment mechanism. Preferably, the first top strap segment may be longer than the second top strap segment and is adapted to removably attach to the second top strap segment via the first strap attachment and adjustment mechanism. The first strap attachment and adjustment mechanism may be positioned adjacent to the second juncture region and may be a cam buckle. The heel strap may comprise: a first heel strap segment, a second heel strap segment, and a second strap attachment and adjustment mechanism. The first heel strap segment may be shorter than the second heel strap segment and may be adapted to removably attach to the second heel strap segment via the second strap attachment and adjustment mechanism. The first strap attachment and adjustment mechanism and second strap attachment and adjustment mechanism may adjust such that the top strap and the heel strap fit matingly on the shoe. The second strap attachment and adjustment mechanism may be positioned adjacent to the second juncture region and may be a cam buckle. The top strap, the bottom strap, and the heel strap may be constructed of a webbing material. A width of the top strap and a width of the heel strap may be approximately 1 inch. The bottom strap may be non-adjustable and may have a width of approximately 1.5 inches. The foot harness may be adapted to hold and secure a fitness tracker wearable.

One embodiment may be a foot harness for resistance exercises, comprising: a top strap; a bottom strap; a heel strap; and one or more attachment points; wherein a first end of the top strap, a first end of the bottom strap, and a first end of the heel strap may be joined at a first juncture region; wherein a second end of the top strap, a second end of the bottom strap, and a second end of the heel strap may be joined at a second juncture region; wherein the top strap may be adapted to engage with an upper portion of a shoe; wherein the bottom strap may be adapted to engage with a bottom portion of the shoe; wherein the heel strap may be adapted to engage with a rear upper portion of the shoe; and wherein the one or more attachment points may be disposed at least at one of the first juncture region and the second juncture region. The top strap may comprise: a first top strap segment, a second top strap segment, and a first strap attachment and adjustment mechanism; wherein the first top strap segment may be longer than the second top strap segment and may be adapted to removably attach to the second top strap segment via the first strap attachment and adjustment mechanism. The first strap attachment and adjustment mechanism may be a cam buckle. The heel strap may comprise: a first heel strap segment, a second heel strap segment, and a second strap attachment and adjustment mechanism; wherein the first heel strap segment may be shorter than the second heel strap segment and may be adapted to removably attach to the second heel strap segment via the second strap attachment and adjustment mechanism. The second strap attachment and adjustment mechanism may be a cam buckle. The top strap, the bottom strap, and the heel strap may be constructed of a webbing material. A width of the top strap and a width of the heel strap may be approximately between 0.5 to 1.5 inches; and wherein the bottom strap may be non-adjustable and may have a width of approximately between 1.0 to 2.0 inches. The bottom strap may further comprise a first indicia; wherein the heel strap may further comprise a second indicia; and wherein the first indicia and the second indicia may facilitate proper positioning of the foot. The one or more attachment points may be D rings. The foot harness may be adapted to hold and secure a fitness tracker wearable.

Another embodiment may be a foot harness for resistance exercises, comprising: a top strap; a bottom strap; a heel strap; a first attachment point; a second attachment point; a first indicia; and a second indicia; wherein a first end of the top strap, a first end of the bottom strap, and a first end of the heel strap may be joined at a first juncture region; wherein a second end of the top strap, a second end of the bottom strap, and a second end of the heel strap may be joined at a second juncture region; wherein the top strap may be adapted to engage with an upper portion of a shoe; wherein the bottom strap may be adapted to engage with a bottom portion of the shoe; wherein the heel strap may be adapted to engage with a rear upper portion of the shoe; wherein the first attachment point may be disposed at the first juncture region; wherein the second attachment point may be disposed at the second juncture region; wherein the first indicia may be positioned within an inner surface of the bottom strap; wherein the second indicia may be positioned within an inner surface of the heel strap; and wherein the first indicia and the second indicia may facilitate proper positioning of the foot. The top strap may comprise: a first top strap segment, a second top strap segment, and a first strap attachment and adjustment mechanism; wherein the first top strap segment may be longer than the second top strap segment and may be adapted to removably attach to the second top strap segment via the first strap attachment and adjustment mechanism; and wherein the first strap attachment and adjustment mechanism may be positioned adjacent to the second juncture region. The first strap attachment and adjustment mechanism may be a cam buckle. The heel strap may comprise: a first heel strap segment, a second heel strap segment, and a second strap attachment and adjustment mechanism; wherein the first heel strap segment may be shorter than the second heel strap segment and may be adapted to removably attach to the second heel strap segment via the second strap attachment and adjustment mechanism; and wherein the second strap attachment and adjustment mechanism may be positioned adjacent to the first juncture region. The second strap attachment and adjustment mechanism may be a cam buckle. The top strap, the bottom strap, and the heel strap may be constructed of a webbing material. A width of the top strap and a width of the heel strap may be approximately 1 inch; and wherein the bottom strap may be non-adjustable and may have a width of approximately 1.5 inches. The first attachment point and the second attachment point may be D rings. The foot harness may be adapted to hold and secure a fitness tracker wearable.

Another embodiment may be a foot harness for resistance exercises, comprising: a top strap; a bottom strap; a heel strap; a first D ring; a second D ring; a first indicia; and a second indicia; wherein a first end of the top strap, a first end of the bottom strap, and a first end of the heel strap may be joined at a first juncture region; wherein a second end of the top strap, a second end of the bottom strap, and a second end of the heel strap may be joined at a second juncture region; wherein the top strap may be adapted to engage with an upper portion of a shoe; wherein the bottom strap may be adapted to engage with a bottom portion of the shoe; wherein the heel strap may be adapted to engage with a rear upper portion of the shoe; wherein the first D ring may be disposed at the first juncture region; wherein the second D ring may be disposed at the second juncture region; wherein the first indicia may be positioned within an inner surface of the bottom strap; wherein the second indicia may be positioned within an inner surface of the heel strap; wherein the first indicia and the second indicia may facilitate proper positioning of the foot; wherein the top strap may comprise: a first top strap segment, a second top strap segment, and a first strap attachment and adjustment mechanism; wherein the first top strap segment may be longer than the second top strap segment and may be adapted to removably attach to the second top strap segment via the first strap attachment and adjustment mechanism; wherein the first strap attachment and adjustment mechanism may be positioned adjacent to the second juncture region and is a cam buckle; wherein the heel strap may comprise: a first heel strap segment, a second heel strap segment, and a second strap attachment and adjustment mechanism; wherein the first heel strap segment may be shorter than the second heel strap segment and may be adapted to removably attach to the second heel strap segment via the second strap attachment and adjustment mechanism; wherein the second strap attachment and adjustment mechanism may be positioned adjacent to the first juncture region and is a cam buckle; wherein the top strap, the bottom strap, and the heel strap may be constructed of a webbing material; wherein a width of the top strap and a width of the heel strap may be approximately 1 inch; wherein the bottom strap may be non-adjustable and may have a width of approximately 1.5 inches; and wherein the foot harness may be adapted to hold and secure a fitness tracker wearable.

In another embodiment, the top strap and heel strap may be constructed of a 1 inch webbing, and the bottom strap, which may be non-adjustable, may be constructed of a 1.5 inch webbing strap. The top strap and heel strap may be adjustable via 1 inch cam buckles. The top strap may comprise a first top strap segment for looping through a cam buckle attachment on the second top strap segment. This enables the user to easily tighten the top strap. The heel strap may comprise a first indicia on the inner surface with the marking "HEEL". The bottom strap may also comprise a second indicia on the inner surface with the marking "STEP ON ME". These indicias may facilitate proper positioning of the users foot on the foot harness. An attachment point on each of the foot harness may allow a band to pass through or be clipped into place, thereby allowing the band to become an extension of the foot in a secure manner. The attachment mechanism can be any form of connection including but not limited to a D ring or it is a spring-gate type mechanism attachment.

In various embodiments, the foot harness may comprise: webbing straps, strapping buckle attachments, plastic strap keepers, webbing tips, and attachment clips. These embodiments may be assembled into a single unit by via sewing process or similar bonding or adhesive process. The foot harness may be utilized in multiple directions, allowing for several completely unique experiences.

It an object to provide a foot harness that allows a user to attach a resistance band to his or her foot for strength building, muscle regeneration, stretching, rehabilitation, strength training, mobility enhancement, range of motion, and other physical therapy or fitness related uses or weight loss and more in a dynamic way. Preferably, the foot harness may be used by children, adults, and the elderly in a variety of ways.

It is an object to provide a foot harness that allows the resistance band to be used from any angle in relationship to the foot. This may be performed by utilizing two attachment points on either side of the foot, to which a resistance band can be secured. This preferably allows the resistance band to lay on top of the foot. The attachment points may be secured on the foot with three uniquely straps: (1) a bottom strap positioned beneath the foot; (2) a heel strap around the heel, and (3) a top strap above the shoe laces/upper of the shoe.

It is an object to provide a foot harness for attaching, securing, and adjusting a resistance band onto a user's foot or shoe. Preferably, the foot harness can be used with a range of resistance band strengths, enabling a custom session by the user.

It is an object to provide a foot harness that may include wearable device technology in the straps, including without limitation, weight distribution, step counting, force exertion, and the like. In various embodiments, the foot harness may utilize an attachment or connection to an electronic wearable device (e.g., a Fitbit®, Jawbone®), which may include various types of wearables.

It is an object to provide a foot harness that may integrate, attach, include a combination of sensor(s) to measure, account for, record, and/or keep track of, user data. Such data may include, without limitation, perspiration, pressure, body temperature (heat), pulse, heart rate, impact on ground, nerve analysis, muscle analysis, joint analysis, posture analysis, weight distribution, body mass index (BMI), oxygen levels.

It is an object to provide a foot harness that utilizes threading string, floss or any material through the inside of the resistance bands in order to prevent the resistance bands from contacting the user if a snap or rupture occurs.

It is an object to provide a foot harness that utilizes attachment points for rope, weight machines and anything else that utilizes the attachment point's position on the foot, It is an object to provide a foot harness that may utilize heat sensors to analyze data about user. Data may or may not include location and distribution of impact on the foot.

It is an object to provide a foot harness that may be integrated with a shoe a single footwear.

It is an object to provide a foot harness that may integrate, attach, include or combine one or more sensor(s) to measure, account for, record. maintain track of, data of user. Some uses may include but not limited to number of repetitions, weight of resistance, body weight, distance traveled, stairs climbed, altitude.

It is an object to overcome the deficiencies of the prior art.

These, as well as other components, steps, features, objects, benefits, and advantages, will now become clear from a review of the following detailed description of illustrative embodiments, of the accompanying drawings, and of the claims.

BRIEF DESCRIPTION OF THE ILLUSTRATIVE EMBODIMENTS

The drawings show illustrative embodiments, but do not depict all embodiments. Other embodiments may be used in addition to or instead of the illustrative embodiments. Details that may be apparent or unnecessary may be omitted for the purpose of saving space or for more effective illustrations. Some embodiments may be practiced with additional components or steps and/or without some or all components or steps provided in the illustrations. When different drawings contain the same numeral, that numeral refers to the same or similar components or steps.

DETAILED DESCRIPTION OF THE ILLUSTRATIVE EMBODIMENTS

Figure 1:
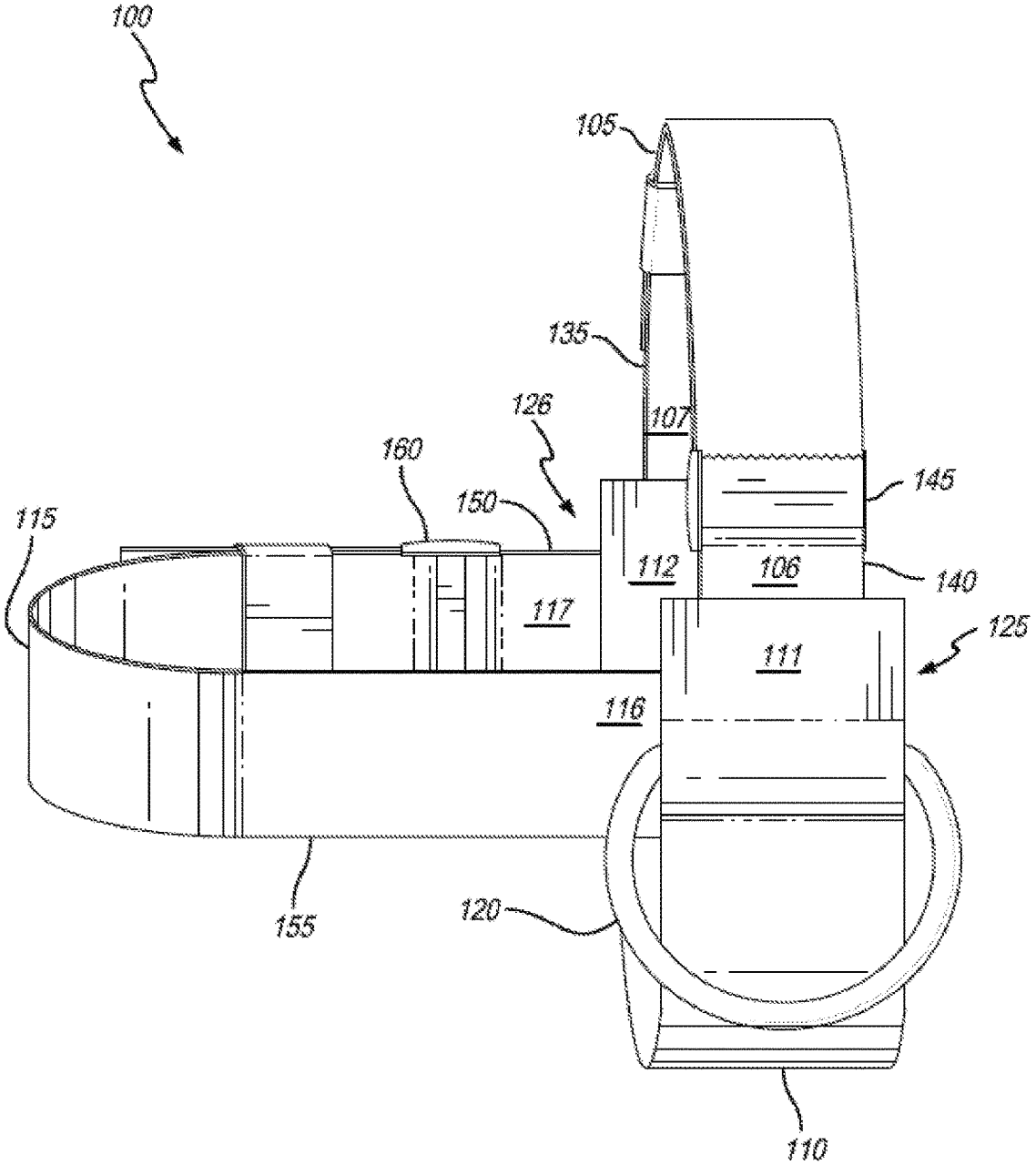
FIG. 1 is a perspective view of one embodiment of the shoe harness.

In the following detailed description of various embodiments, numerous specific details are set forth in order to provide a thorough understanding of various aspects of the embodiments. However, the embodiments may be practiced without some or all of these specific details. In other instances, well-known procedures and/or components have not been described in detail so as not to unnecessarily obscure aspects of the embodiments.

While some embodiments are disclosed here, other embodiments will become obvious to those skilled in the art as a result of the following detailed description. These embodiments are capable of modifications of various obvious aspects, all without departing from the spirit and scope of protection. The Figures, and their detailed descriptions, are to be regarded as illustrative in nature and not restrictive. Also, the reference or non-reference to a particular embodiment shall not be interpreted to limit the scope of protection.

Reference throughout this specification to "one embodiment", "an embodiment", or "another embodiment" may mean that a particular feature, structure, or characteristic described in connection with the embodiment may be included in at least one embodiment of the present disclosure. Thus, appearances of the phrases "in one embodiment" or "in an embodiment" in various places throughout this specification may not necessarily refer to the same embodiment.

Furthermore, the described features, structures, or characteristics may be combined in any suitable manner in one or more embodiments. In the following description, numerous specific details are provided, such as examples of materials, fasteners, sizes, lengths, widths, shapes, etc., to provide a thorough understanding of the embodiments. One skilled in the relevant art will recognize, however, that the scope of protection can be practiced without one or more of the specific details, or with other methods, components, materials, etc. In other instances, well-known structures, materials, or operations are generally not shown or described in detail to avoid obscuring aspects of the disclosure.

DEFINITIONS

In the following description, certain terminology is used to describe certain features of one or more embodiments. For purposes of the specification, unless otherwise specified, the term "substantially" refers to the complete or nearly complete extent or degree of an action, characteristic, property, state, structure, item, or result. For example, in one embodiment, an object that is "substantially" located within a housing would mean that the object is either completely within a housing or nearly completely within a housing. The exact allowable degree of deviation from absolute completeness may in some cases depend on the specific context. However, generally speaking the nearness of completion will be so as to have the same overall result as if absolute and total completion were obtained. The use of "substantially" is also equally applicable when used in a negative connotation to refer to the complete or near complete lack of an action, characteristic, property, state, structure, item, or result.

As used herein, the terms "approximately" and "about" generally refer to a deviance of within 5% of the indicated number or range of numbers. In one embodiment, the term "approximately" and "about", may refer to a deviance of 0.0001-10% from the indicated number or range of numbers.

FIG. 1 is a perspective view of one embodiment of the shoe harness. As shown in FIG. 1, one embodiment of the shoe harness 100 may comprise: a top strap 105, a bottom strap 110, a heel strap 115, and a first attachment point 120. The top strap 105, bottom strap 110, and heel strap 115 are preferably strips of flexible material used to fasten and secure the shoe harness 100 around portions of a shoe of a user. For example, the top strap 105 may be adapted to engage with an upper portion of a shoe. Additionally, the bottom strap 110 may be adapted to engage with a bottom portion (sole) of the shoe, whereas the heel strap 115 may be adapted to engage with a rear portion (upper heel) of the shoe.

In one embodiment, the top strap 105, bottom strap 110, and/or heel strap 115 may be constructed of various materials such as nylon, polyester, cotton, polypropylene, elastic, and the like. Alternatively, the top strap 105, bottom strap 110, and/or heel strap 115 may be constructed of plastic, metal or rubber materials. The top strap 105, bottom strap 110, and/or heel strap 115 may also be woven as webbing material. In various embodiments, the top strap 105, bottom strap 110, and/or heel strap 115 may be constructed in varying width, thicknesses or lengths, providing that the top strap 105, bottom strap 110, and/or heel strap 115 have the strength necessary to use the foot harness 100 without failing and causing injury to the user.

In one embodiment, the width of the top strap 105 and the width of the heel strap 115 may be approximately between 0.5 and 1.5 inches. In a preferred embodiment, the width of the top strap 105 and the width of the heel strap 115 may be approximately 1 inch. The bottom strap 110 may have a width between approximately 1.0 to 2.0 inches, and, in a preferred embodiment, the bottom strap 110 may have a width of approximately 1.5 inches.

The top strap 105, bottom strap 110, and/or heel strap 115 may each have two ends—a first end and a second end. Preferably, the first end 106 of the top strap 105, the first end 111 of the bottom strap 110, and the first end 116 of the heel strap 115 are coupled to one another at a first juncture region 125 and may be coupled or attached via sewn, stitching, adhesive, coupling/buckle, cement, and the like.

Similarly, the top strap 105, bottom strap 110, and/or heel strap 115 may each have a second end or opposing end. Preferably, the second end 107 of the top strap 105, the second end 112 of the bottom strap 110, and the second end 117 of the heel strap 115 are also coupled to one another at a second juncture region 126 and may also be coupled or attached via sewn, stitching, adhesive, coupling/buckle, cement, and the like.

Figure 2:
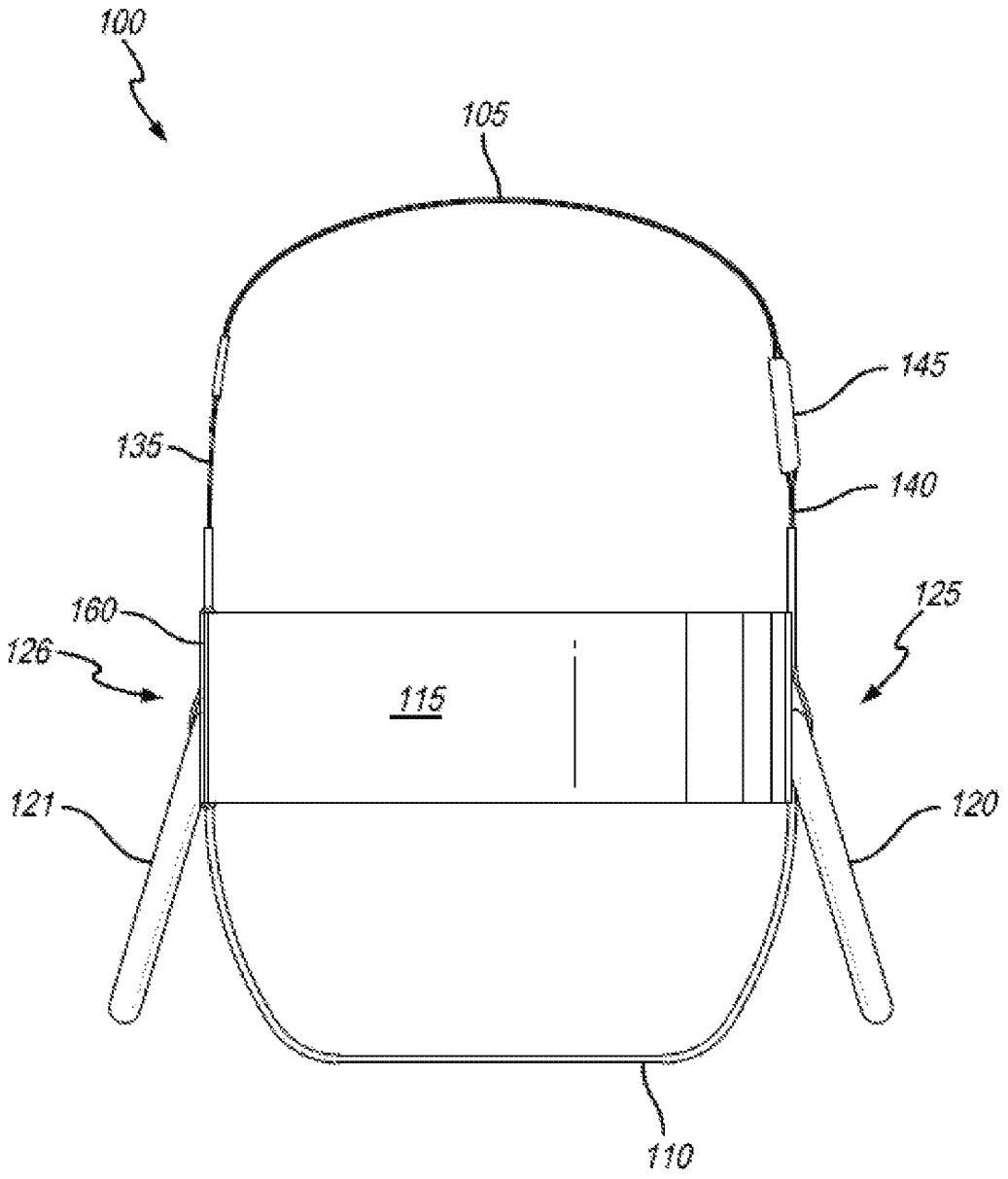
FIG. 2 is a rear view of one embodiment of the shoe harness.

The attachment points 120, 121 (121 is shown in FIG. 2) preferably refer to one or more positions within the foot harness 100 with closed rings, which may provide a place for attaching a resistance band or tether. In various embodiments, the attachment points 120, 121 may be connectors, such as closed rings, carabiners, hooks, straps, magnets, swivel snaps, loops, slides, bolt snaps and the like. In a preferred embodiment, the attachment points 120, 121 may be D rings, as shown.

FIG. 1 also shows that the foot harness 100 may have two attachment points 120, 121, each of which are preferably located or positioned at a junction region 125, 126 or near the junction region 125, 126. For example, the first attachment point 120 may be positioned at the first junction region 125, and the second attachment point 121 may be positioned at the second junction region 126.

In one embodiment, the foot harness 100 may comprise one or more indicia, which is preferably any marking(s) that facilitate proper positioning of the shoe/foot within the foot harness 100. For example, in one embodiment, a first indicia 305 (shown in FIG. 3) may be positioned on an inner surface of the bottom strap 110 and may comprise the words "STEP ON ME". This may provide the user with an indication as to have the bottom portion of the shoe or user's foot placed against the bottom strap 110. Similarly, in another embodiment, a second indicia 405 (shown in FIG. 4) may be positioned within an inner surface of the heel strap 115 and may comprise the word "HEEL". Here, this may indicate to the user to have the heel strap 115 placed against the heel portion of the shoe or user's heel. In various embodiments, the indicia may be created via vinyl, stitching, or dye.

FIG. 1 also shows that the top strap 105 may comprise several components, including: a first top strap segment 135, a second top strap segment 140, and a first strap attachment and adjustment mechanism 145. The first top strap segment 135 and second top strap segment 140 are preferably strips of flexible material that are used to fasten together to secure the top strap 105 around the top portion of the shoe or foot of the user. Preferably, the first strap attachment and adjustment mechanism 145 is preferably device or component that mechanically joins or affixes the first top strap segment 135 and second top strap segment 140 together. Preferably, the first strap attachment and adjustment mechanism 145 is also adapted to adjust the fastening of the first top strap segment 135 and second top strap segment 140. For example, in various embodiments, the first strap attachment and adjustment mechanism 145 may be a snap fastener, buckle, tie, clip, hook and loop fastener, pin, strap, zipper, snap buckles, side release buckles, strap slides, military buckles, center release buckles, magnets, heel bar buckles, clasps, rubber mechanisms, and the like. In a preferred embodiment, the first strap attachment and adjustment mechanism 145 may be buckle such as a cam buckle. Preferably, the first strap attachment and adjustment mechanism 145 may allow for a tightening and fastening of the foot harness 100 onto the foot, as well as the removal of the foot harness 100 from the foot. This will allow the shoe harness 100 to be firmly secured on the foot or shoe because the secured top strap 105 lacks slack to allow the shoe harness 100 to slip off the toe or heel.

In another embodiment, the first top strap segment 135 may be longer than the second top strap segment 140 and may be adapted to removably attach to the second top strap segment 140 via the first strap attachment and adjustment mechanism. Thus, in this embodiment, the first strap attachment and adjustment mechanism 145 may be positioned near adjacent to the first juncture region 125. In another embodiment, the first top strap segment 135 may be shorter than the second top strap segment 140. Thus, in this embodiment, the first strap attachment and adjustment mechanism 145 may be positioned near adjacent to the second juncture region 126.

In one embodiment, the first strap attachment and adjustment mechanism 145 may be positioned near or adjacent to the second juncture region 126. In another embodiment, the first strap attachment and adjustment mechanism 145 may be positioned adjacent to the first juncture region 125.

Similarly, FIG. 1 also shows that the heel strap 105 may comprise several components, including: a first heel strap segment 150, a second heel strap segment 155, and a second strap attachment and adjustment mechanism 160. Like the first top strap segment 140 and the second top strap segment 145, the first heel strap segment 150 and second heel strap segment 155 are preferably strips of flexible material that are used to fasten together to secure the heel strap 115 around the heel portion of the shoe or foot of the user. Like the first strap attachment and adjustment mechanism 145, the second strap attachment and adjustment mechanism 160 is also preferably a device or component that mechanically joins or affixes the first heel strap segment 150 and second heel strap segment 155 together. Preferably, the second strap attachment and adjustment mechanism 160 is also adapted to adjust the fastening of the first heel strap segment 150 and second heel strap segment 155. For example, in various embodiments, the second strap attachment and adjustment mechanism 160 may be a snap fastener, buckle, tie, clip, hook and loop fastener, pin, strap, or zipper. In a preferred embodiment, the second strap attachment and adjustment mechanism 160 may be buckle such as a cam buckle. This will allow the shoe harness 100 to be firmly secured on the foot or shoe because the secured heel strap 105 lacks slack to allow the shoe harness 100 to slip off the toe or heel.

In another embodiment, the second heel strap segment 155 may be longer than the first heel strap segment 150 and may be adapted to removably attach to the first heel strap segment 150 via the second strap attachment and adjustment mechanism 160. Thus, in this embodiment, the second strap attachment and adjustment mechanism 160 may be positioned near or adjacent to the second juncture region 126. In another embodiment, the second heel strap segment 155 may be shorter than the first heel strap segment 150. Thus, in that other embodiment, the second strap attachment and adjustment mechanism 160 may be positioned near or adjacent to the first juncture region 125. Preferably, the bottom strap 110 lacks a strap attachment and adjustment mechanism, but it is contemplated that the bottom strap 110 may have a strap attachment and adjustment mechanism. Further, although FIG. 1 shows the top strap 105, bottom strap 110, and heel strap 115 as separate pieces, the top strap, bottom strap, and heel strap may be integrated as a single piece or molded device.

In various embodiments, the foot harness 100 may also comprise one or more sensors for tracking repetitions, calories burned, distance by both steps and arm motions, weight of resistance, body weight, distance traveled, stairs climbed, altitude, sweat, pressure, heat, pulse, heart rate, impact on ground, nerve analysis, muscle analysis, joint analysis, posture analysis, weight distribution, bmi, oxygen levels. Preferably, the sensors may communicate data and analytics to user's phone or tablet application, website or personal computer or laptop application.

FIG. 2 is a rear view of one embodiment of the shoe harness. As shown in FIG. 2, one embodiment of the shoe harness 100 may comprise: a top strap 105, a bottom strap 110, a heel strap 115, a first attachment point 120, and a second attachment point 121. Importantly, FIG. 2 shows that, in this embodiment, the first attachment point 120 is positioned near or adjacent to the first juncture point 125 while the second attachment point 121 is positioned near or adjacent to the second juncture point 126. It should be understood, however, that, in another embodiment, the first attachment point 120 may be positioned near or adjacent to the first juncture point 126 while the second attachment point 121 may be positioned near or adjacent to the second juncture point 125.

Additionally, FIG. 2 shows that first top strap segment 135 may be longer than the second top strap segment 140 and that the first heel strap segment 150 may be shorter than the second heel strap segment 155. It should be understood, however, that, in another embodiment, first top strap segment 135 may be shorter than the second top strap segment 140 and that the first heel strap segment 150 may be longer than the second heel strap segment 155. FIG. 2 also shows that the first attachment point 120 and the second attachment point 121 may be D rings.

Figure 3:
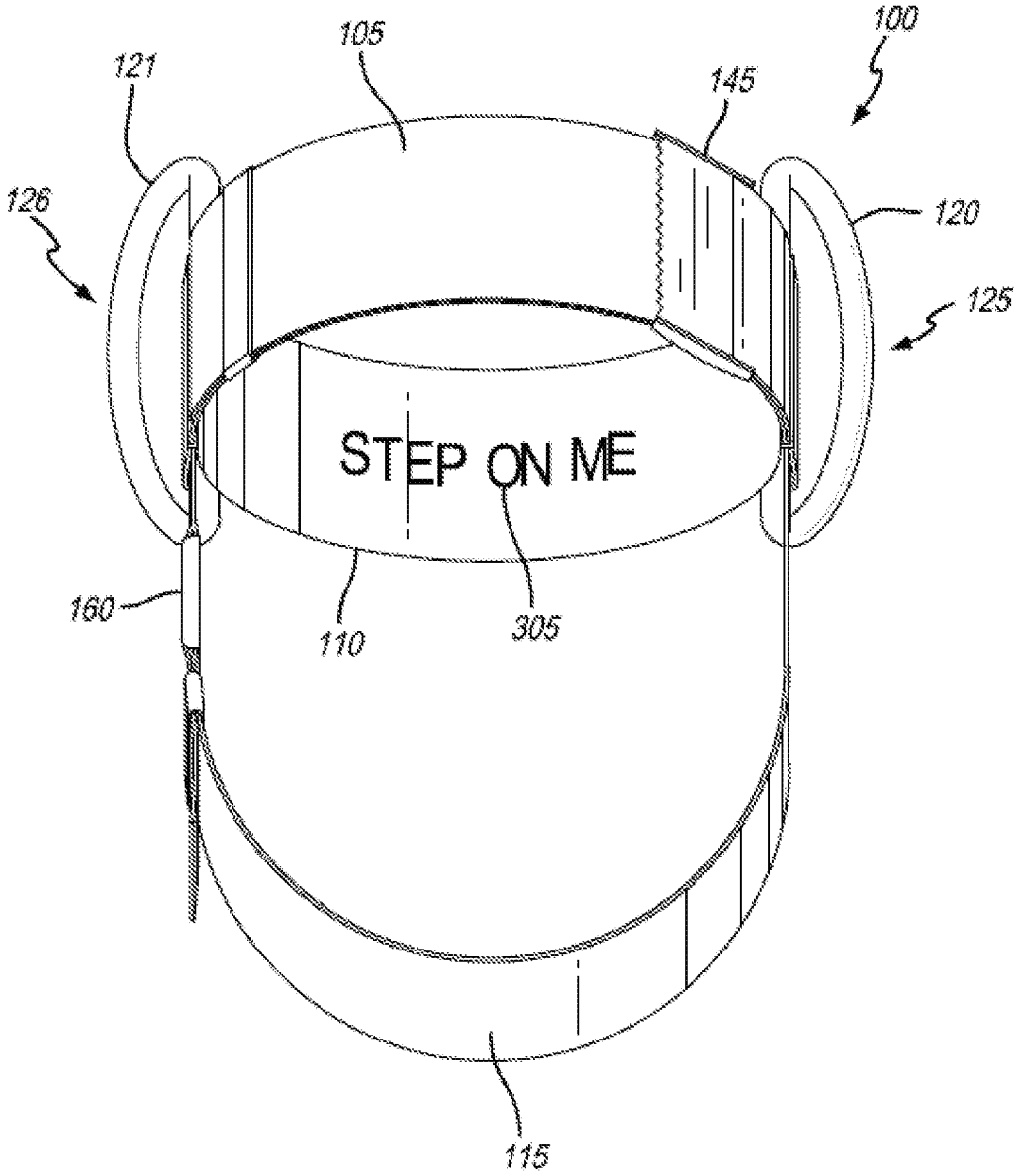
FIG. 3 is a top view of one embodiment of the shoe harness.

FIG. 3 is a top view of one embodiment of the shoe harness. As shown in FIG. 3, one embodiment of the shoe harness 100 may comprise: a top strap 105, a bottom strap 110, a heel strap 115, a first attachment point 120, and a second attachment point 121. Importantly, FIG. 3 shows that the foot harness 100 may comprise a first indicia 305, which is preferably a marking that facilitates proper positioning of the shoe within the foot harness 100. In this embodiment, the first indicia 305 may be positioned on an inner surface of the bottom strap 110 and may comprise the words "STEP ON ME". This may provide the user with an indication as to have the bottom portion of the shoe or user's foot placed against the bottom strap 110.

Figure 4:
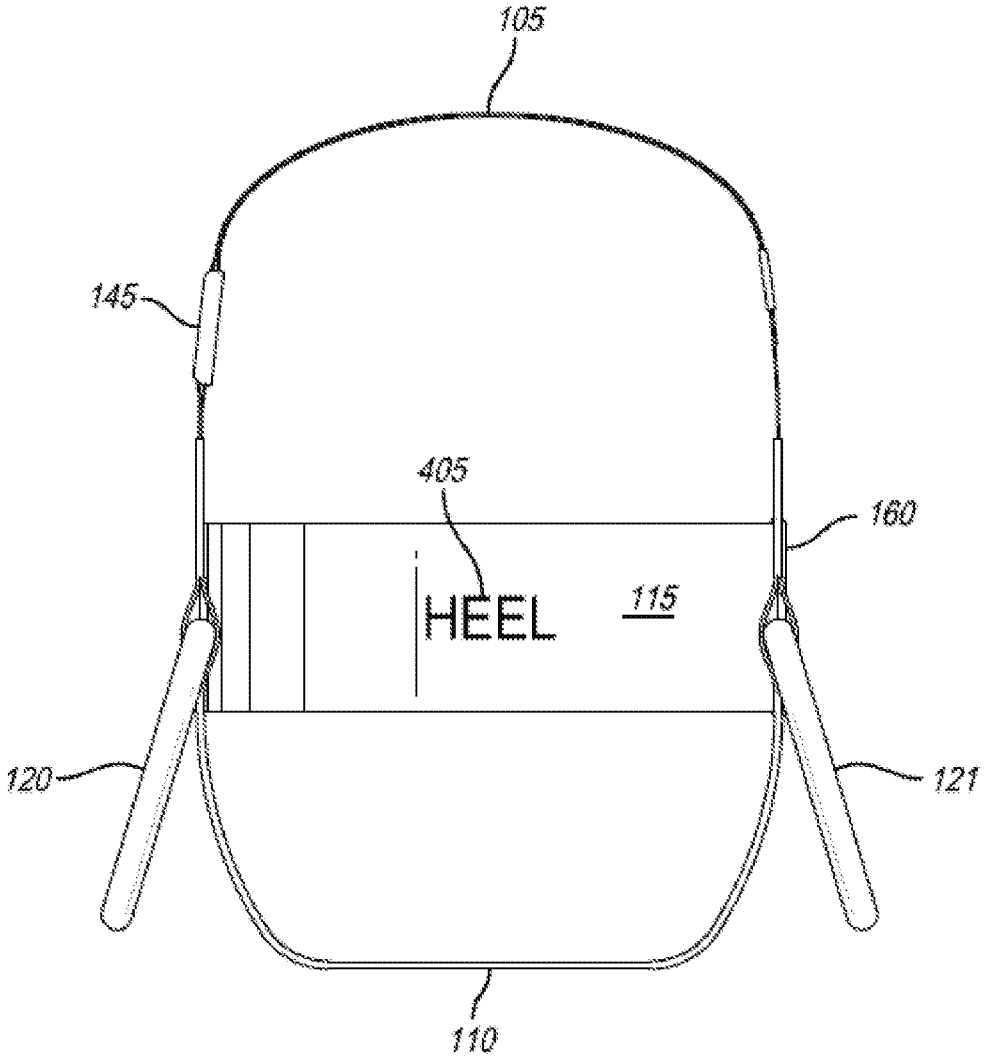
FIG. 4 is a front view of one embodiment of the shoe harness.

FIG. 4 is a front view of one embodiment of the shoe harness. As shown in FIG. 4, one embodiment of the shoe harness 100 may comprise: a top strap 105, a bottom strap 110, a heel strap 115, a first attachment point 120, and a second attachment point 121. Importantly, FIG. 4 shows that the foot harness 100 may comprise a second indicia 405, which is preferably a marking that facilitates proper positioning of the shoe within the foot harness 100. In this embodiment, the second indicia 405 may be positioned on an inner surface of the heel strap 115 and may comprise the word "HEEL". This may provide the user with an indication as to have the heel portion of the shoe or user's foot placed against the inner surface of the heel strap 115.

Figure 5:
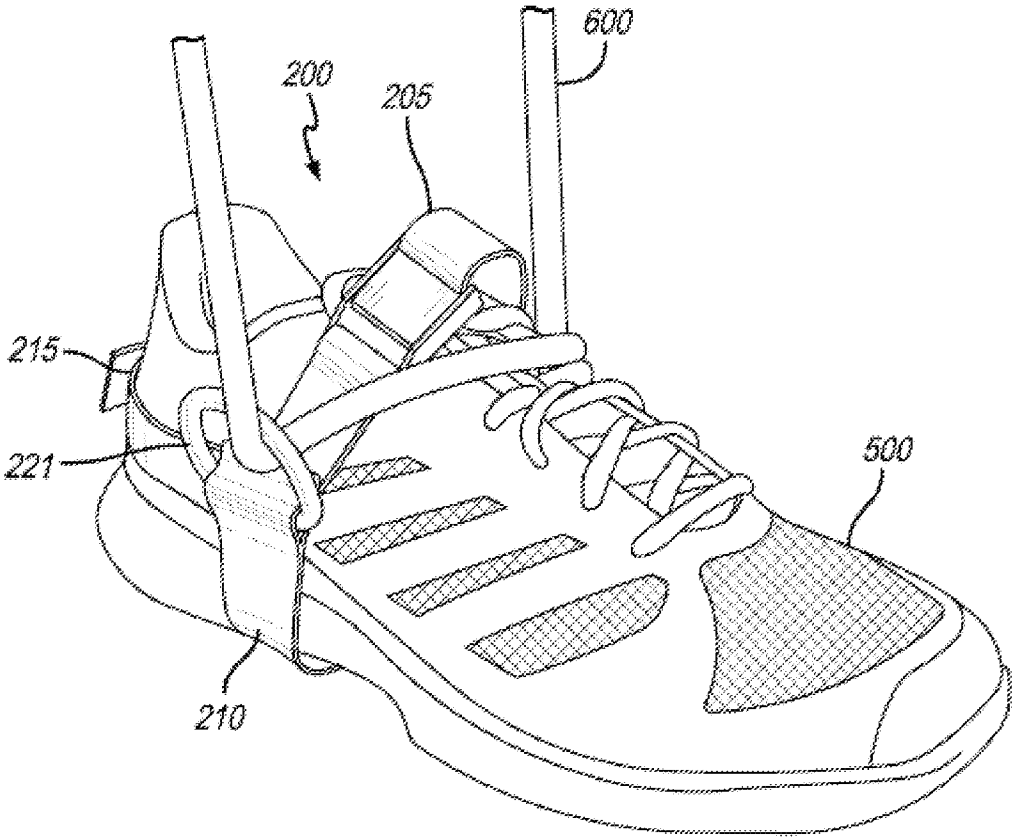
FIG. 5 is a view of another embodiment of the shoe harness engaged with a shoe and resistance band.

FIG. 5 is a view of another embodiment of the shoe harness engaged with a shoe and resistance band. As shown in FIG. 5, another embodiment of the shoe harness 200 may comprise: a top strap 205, a bottom strap 210, a heel strap 215, a first attachment point 220 and a second attachment point 221. FIG. 5 shows that one embodiment of the shoe harness 200 may be configured to engage with a right shoe 500. Specifically, FIG. 5 shows: (1) that the top strap 205 is preferably adapted to engage with an upper portion of a shoe 500; (2) that the bottom strap 210 is preferably adapted to engage with a bottom portion of the shoe 500; and (3) that the heel strap 215 is preferably adapted to engage with a rear portion of the shoe 500.

Additionally, FIG. 5 shows how a resistance band 600 may engage with the attachment points 220, 221 of the shoe harness 200. This may provide proper anchoring of the resistance band 600 with the shoe harness 200.

Figure 6A:
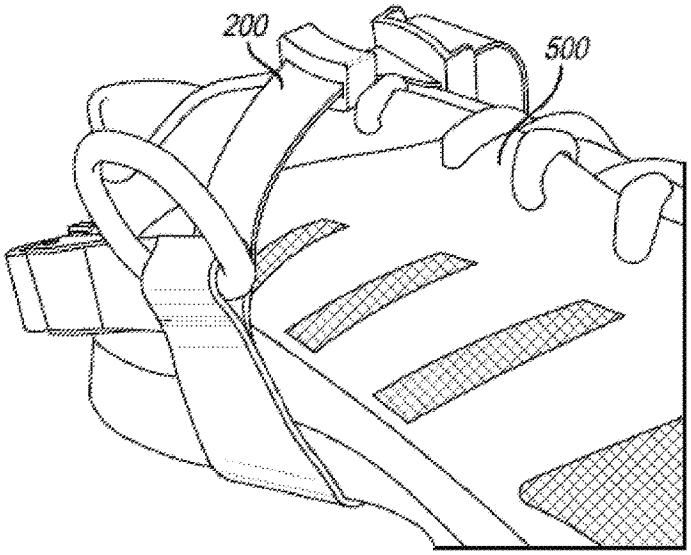
FIGS. 6A and 6B are illustrations of two embodiments of the shoe harness for a left shoe and a right shoe.
Figure 6B:
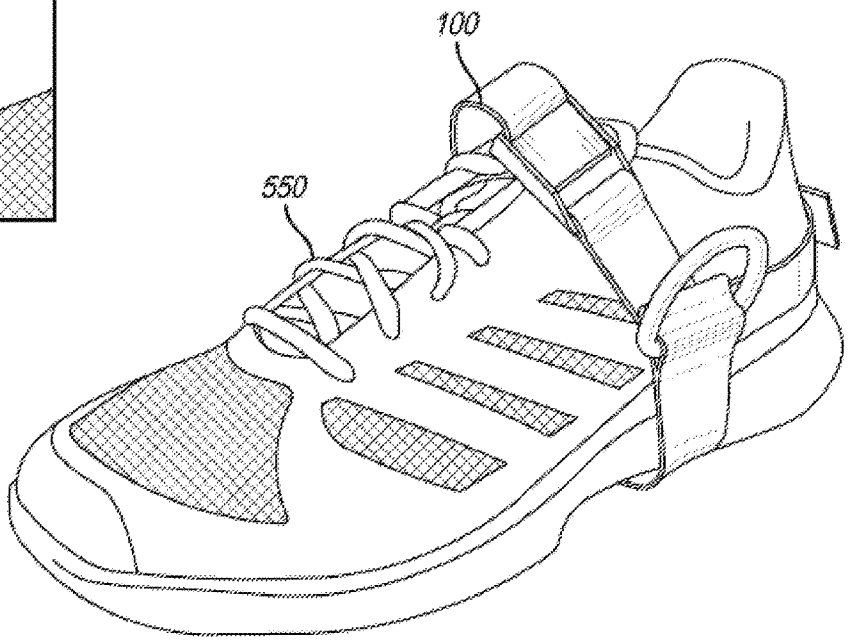

FIGS. 6A and 6B are illustrations of two embodiments of the shoe harness for a left shoe and a right shoe. Specifically, FIG. 6A shows that the shoe harness 200 may be configured to engage with a right shoe 500, whereas FIG. 6B shows that the shoe harness 100 may be configured to engage with a left shoe 550. Thus, the user may be able to anchor two (or more) resistance bands for the shoes 500, 550, as shown in FIG. 7.

Figure 7:
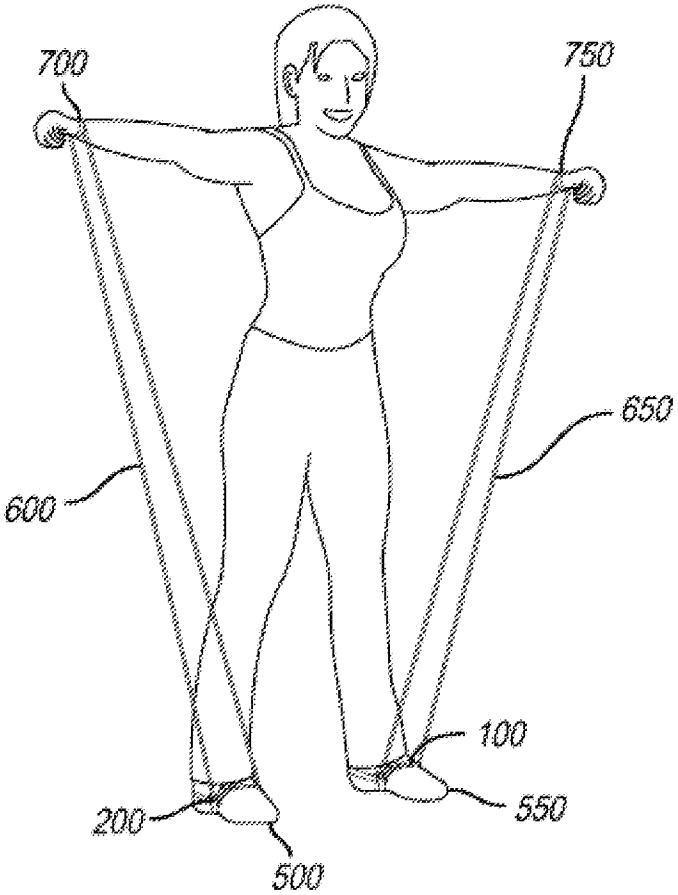
FIG. 7 is an illustration of two embodiments of the shoe harness engaged with a pair of shoes worn by a user and shows resistance bands engaged with the shoe harnesses and held by the user.

FIG. 7 is an illustration of two embodiments of the shoe harness engaged with a pair of shoes worn by a user and shows resistance bands engaged with the shoe harnesses and held by the user. Specifically, FIG. 7 shows that the shoe harnesses 100, 200 may be adapted to engage with a left shoe 550 and the right shoe 500, respectively. FIG. 7 also shows how resistance bands 650, 600 may engage with a left shoe 550 and the right shoe 500, respectively.

FIG. 7 shows that the user may utilize wrist straps 700, 750 for anchoring the opposing end of the resistance bands 650, 600 so that the user may be able to perform various resistance based exercises his or her arms. For instance, as shown in FIG. 7, the user may perform curling exercises by lifting his or her arms up until the forearms are vertical with the elbows and upper arm remaining close to the body.

Figure 8:
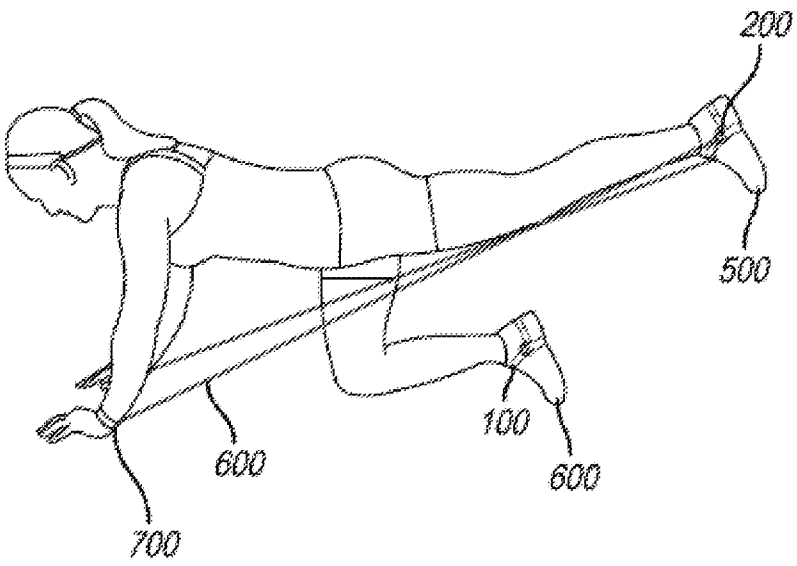
FIG. 8 is an illustration of a view of two embodiments of the shoe straps shown in use.

FIG. 8 is a view of two embodiments of the shoe straps shown in use. As shown in FIG. 8, the user may wear both shoe harnesses 100, 200 for his or her shoes 500, 600 and engage a resistance band 600 with a shoe harness 200. Depending on his or her posture or position, the user may perform one or more leg exercises. For example, while in a crawling position, the user may anchor one end of the resistance band 600 by holding and securing the wrist strap 700 on the ground. The user may then perform a leg exercise by extending his or her leg, which may strengthen his or her thigh muscle. Although FIG. 8 shows a single leg exercise, various leg and arm exercises may be performed with the shoe harnesses 100, 200 and resistance bands 600, 650.

Figure 9:
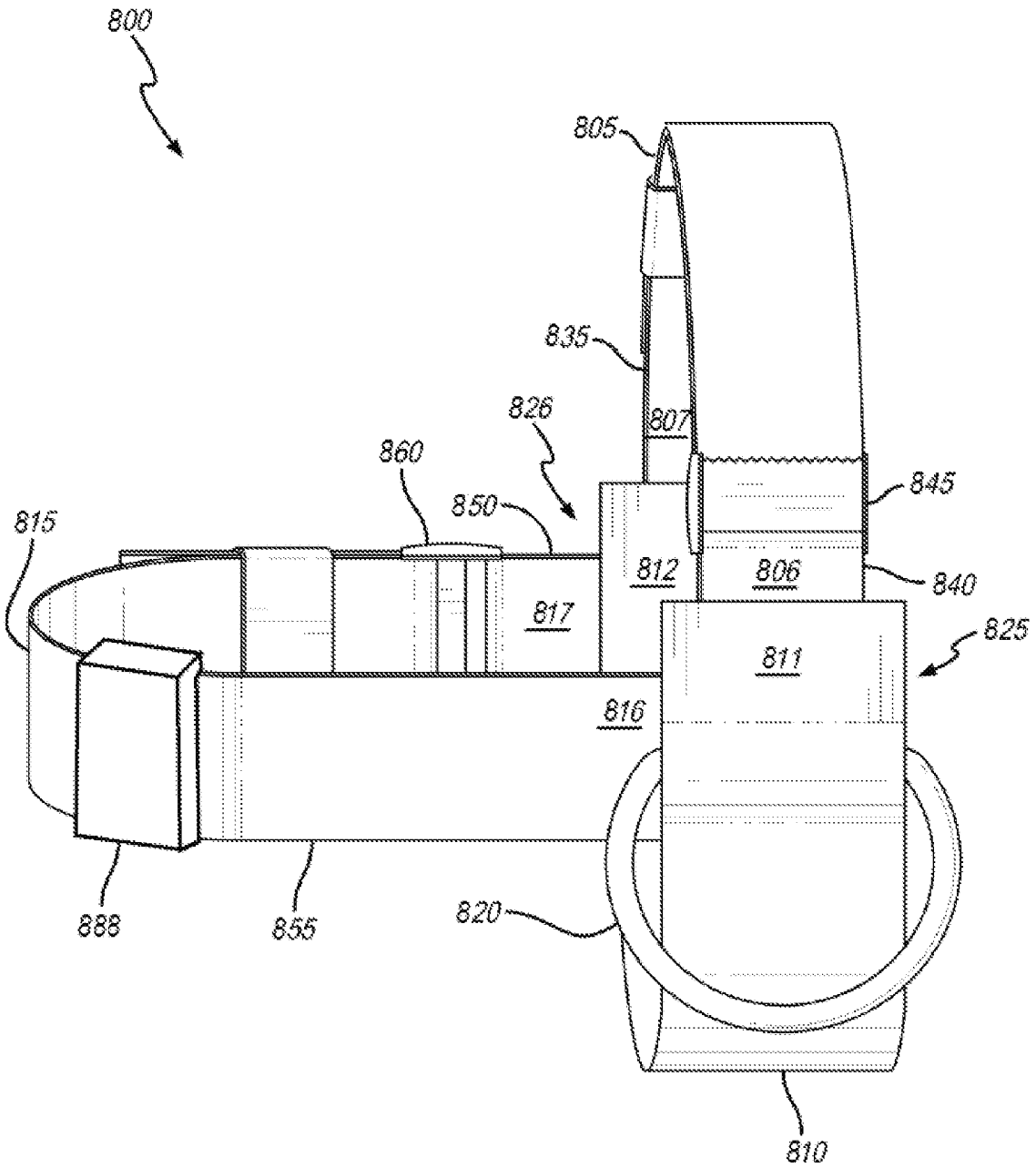
FIG. 9 is an illustration of a perspective view of another embodiment of the shoe harness and shows the shoe harness with a fitness tracker wearable.

FIG. 9 is a perspective view of another embodiment of the shoe harness and shows the shoe harness with a fitness tracker wearable. As shown in FIG. 9, another embodiment of the shoe harness 800 may comprise: a top strap 805, a bottom strap 810, a heel strap 815, and a first attachment point 820. The first end 806 of the top strap 805, the first end 811 of the bottom strap 810, and the first end 816 of the heel strap 815 may be coupled to one another at a first juncture region 825. The second end 807 of the top strap 805, the second end 812 of the bottom strap 810, and the second end 817 of the heel strap 815 may also be coupled to one another at a second juncture region 826.

Importantly, unlike the embodiment shown in FIGS. 1-4, FIG. 9 shows that the shoe harness 800 may also comprise a fitness tracker wearable 888. The fitness tracker wearable may couple to a strap of the shoe harness 800 (e.g., top strap 805, a bottom strap 810, a heel strap 815) via sliding and/or fastening and is preferably used to monitor and track fitness-related metrics.

In a preferred embodiment, the fitness tracker wearable 888 preferably comprises: an accelerometer, power source (e.g., battery), microcontroller, charge port, and a computer readable medium (e.g., micro data storage unit). These components will preferably allow the fitness tracker wearable 888 to monitor the following, without limitation, repetitions, calories burned, distance by both steps and arm motions, weight of resistance, body weight, distance traveled, stairs climbed, altitude, sweat, pressure, heat, pulse, heart rate, impact on ground, nerve analysis, muscle analysis, joint analysis, posture analysis, weight distribution, bmi, oxygen levels. The fitness tracker wearable 888 may also communicate data and analytics to user's phone or tablet application, website or personal computer or laptop application.

Figure 10:
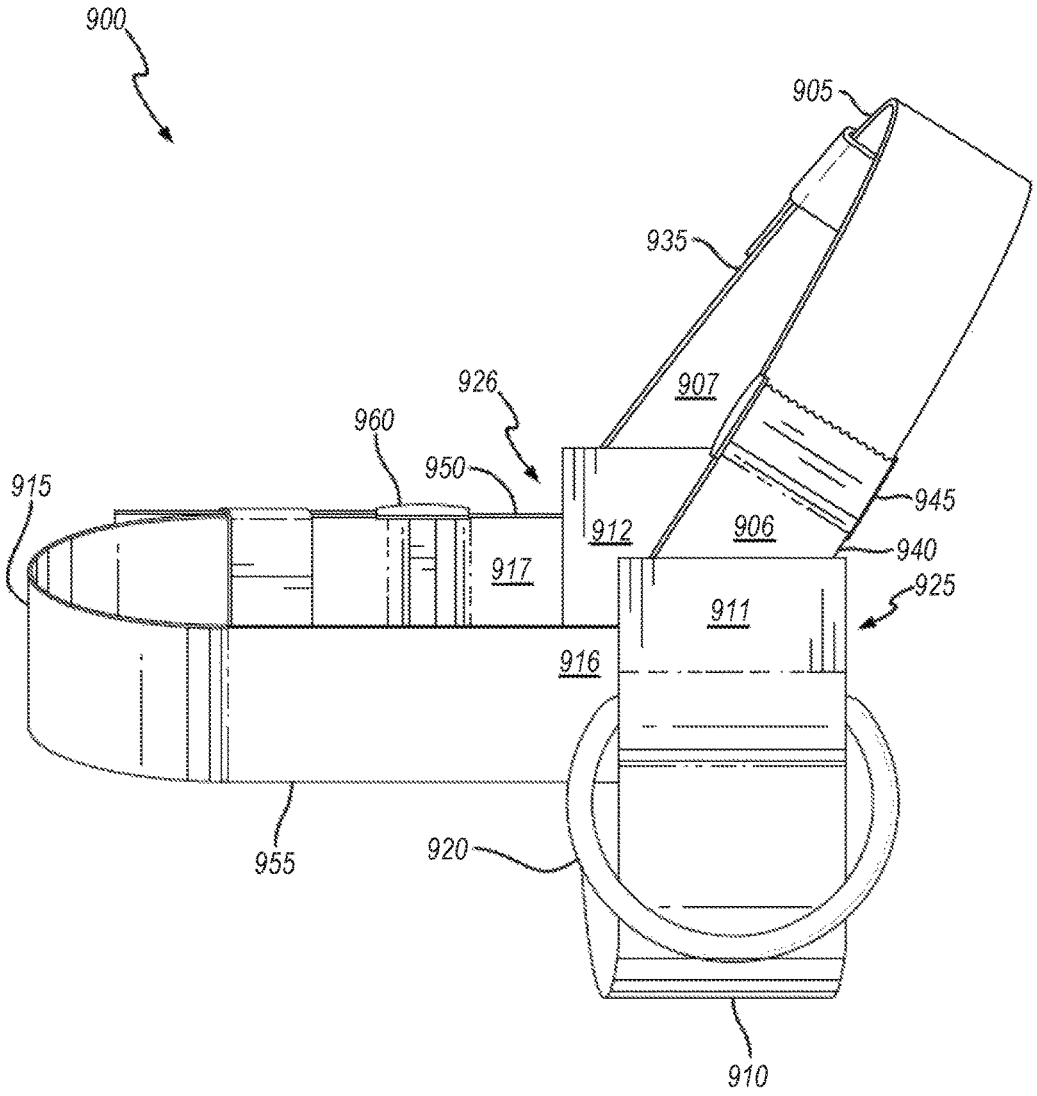
FIG. 10 is an illustration of a perspective view of another embodiment of the shoe harness and shows the shoe harness with the top strap angled around the front of a user's ankle.

FIG. 10 is a perspective view of another embodiment of the shoe harness and shows the shoe harness with the top strap angled around the front of a user's ankle. As shown in FIG. 9, another embodiment of the shoe harness 900 may comprise: a top strap 905, a bottom strap 910, a heel strap 915, a first attachment point D-Ring 920, and a second attachment point D-Ring. The first end 906 of the top strap 905, the first end 911 of the bottom strap 910, and the first end 916 of the heel strap 915 may be coupled to one another at a first juncture region 925. The second end 907 of the top strap 905, the second end 912 of the bottom strap 910, and the second end 917 of the heel strap 915 may also be coupled to one another at a second juncture region 926.

FIG. 9 shows that the foot harness for resistance exercises may comprise: a top strap 905, a bottom strap 910, a heel strap 915, a first D ring 920, which is D-shaped, a second D ring (shown in FIG. 3), which is D-shaped, a first indicia (shown in FIG. 3), and a second indicia (shown in FIG. 4). The first end 906 of the top strap 905, a first end 911 of the bottom strap 910, and a first end 916 of the heel strap 915 may be joined at a first juncture region 925. A second end 907 of the top strap 905, a second end 912 of the bottom strap 910, and a second end 917 of the heel strap 915 are joined at a second juncture region 926. The top strap 905 may be adapted to engage with an upper portion of a shoe (shown in FIG. 5). The bottom strap 910 may be adapted to engage with a bottom portion of the shoe (shown in FIG. 5). The heel strap 915 may be adapted to engage with a rear upper portion of the shoe (shown in FIG. 5). The first D ring 920 may be disposed at the first juncture region 925, such that a straight portion of the first D ring is disposed within a middle portion of the first juncture region 925 and the straight portion of the first D ring 920 is substantially parallel to a sole of the shoe (or the ground upon which the shoe rests), and such that a curved portion of the first D ring 920 is rotatable approximately 180 degrees from pointing upward to pointing downward, and such that the first D ring 920 rests pointing downward when not engaged, as shown in FIG. 10. The second D ring (shown in FIGS. 2-4) may be disposed at the second juncture region 926, such that a straight portion of the second D ring is disposed within a middle portion of the second juncture region 926 and the straight portion of the second D ring is substantially parallel to a sole of the, and such that a curved portion of the second D ring is rotatable approximately 180 degrees from pointing upward to pointing downward, and such that the second D ring rests pointing downward when not engaged (as shown in FIGS. 2-4). The first junction region 925 and the second junction region 925 may be positioned such that they are on direct opposite sides of the shoe (shown in FIGS. 2-4). The first indicia may be positioned within an inner surface of the bottom strap, as shown in FIG. 3. The second indicia may be positioned within an inner surface of the heel strap, as shown in FIG. 4. The first indicia and the second indicia may facilitate proper positioning of the foot. The top strap 905 may comprise: a first top strap segment 935, a second top strap segment 940, and a first strap attachment and adjustment mechanism 945. Preferably, the one of the two top strap segments 935, 940 is longer than the other and they are adapted to removably attach to each other via the first strap attachment and adjustment mechanism 945. The first strap attachment and adjustment mechanism 945 may be positioned adjacent to one of the two juncture regions 925, 926 and may be a cam buckle. The heel strap 915 may comprise: a first heel strap segment 950, a second heel strap segment 955, and a second strap attachment and adjustment mechanism 960.

Preferably, one of the two heel strap segments 950, 955 is longer than the other and they are adapted to removably attach to each other via the second strap attachment and adjustment mechanism 960.

The first strap attachment and adjustment mechanism 945 and second strap attachment and adjustment mechanism 960 may adjust such that the top strap 905 and the heel strap 915 fit matingly on the shoe. The second strap attachment and adjustment mechanism 960 may be positioned adjacent to one of the two juncture regions 925, 926 and may be a cam buckle. The top strap 905, the bottom strap 910, and the heel strap 915 may be constructed of a webbing material. A width of the top strap 905 and a width of the heel strap 915 may be approximately 1 inch. The bottom strap 910 may be non-adjustable and may have a width of approximately 1.5 inches.

Although FIG. 10 shows the attachment and adjustment mechanisms 945, 960 near a particular juncture region 925, 926, they may be next to either juncture region 925, 926 and may be next to opposite juncture regions 925, 926.

Figure 11:
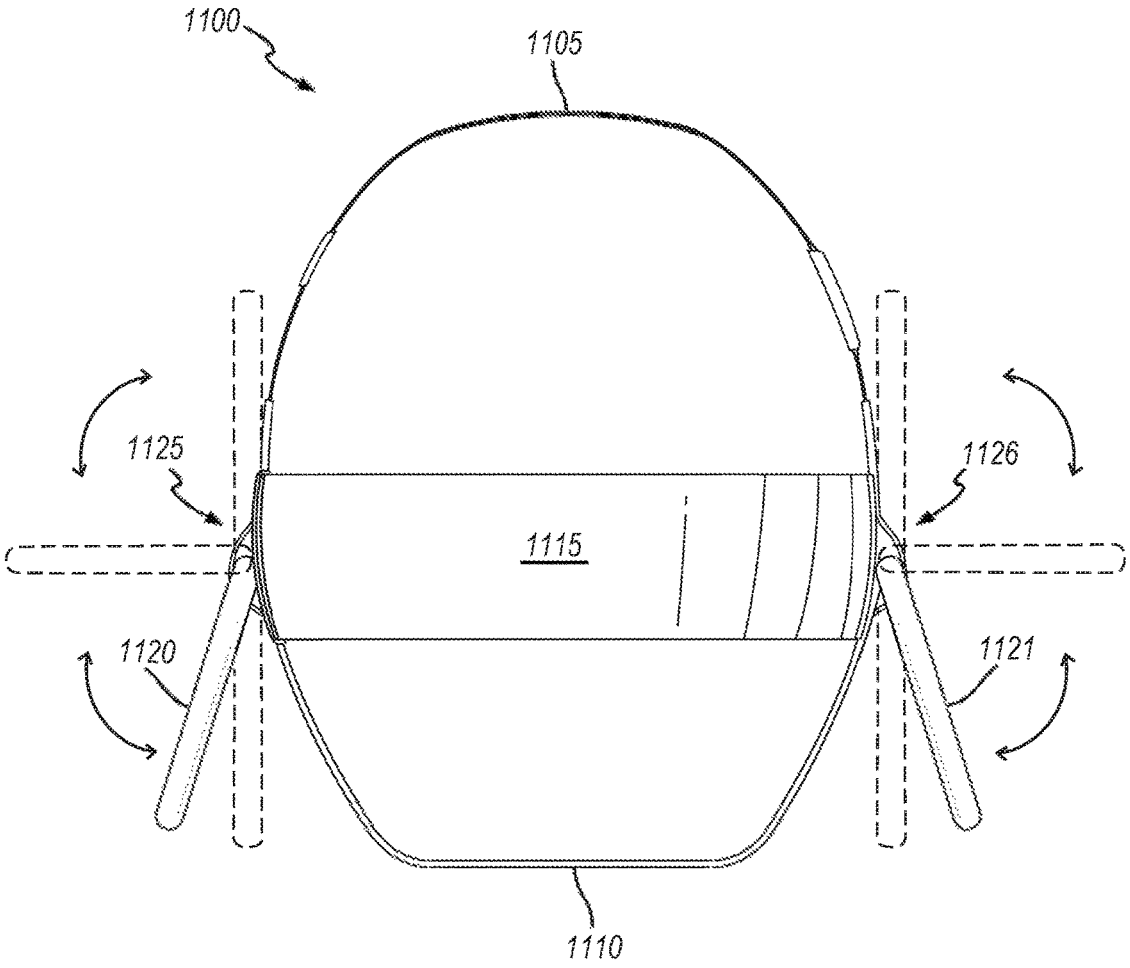
FIG. 11 is an illustration of a rear view of another embodiment of the shoe harness and shows the D-Ring connector being rotatable at least 180 degrees.

FIG. 11 is an illustration of a rear view of another embodiment of the shoe harness and shows the D-Ring connector being rotatable at least 180 degrees. As shown in FIG. 11, the shoe harness 1100 may comprise a top strap 1105, a bottom strap 1100, heel strap 1115, a first D-Ring

1120, a second D-Ring 1121, and two juncture regions 1125, 1126. The two juncture regions 1125, 1126 are where the ends of the top strap 1105, bottom strap 1100, and heel strap 1115, may be joined. The first D-Ring 1120 may be disposed at the first juncture region 1125, such that a straight portion of the first D-Ring is disposed within a middle portion of the first juncture region 1125 and the straight portion of the first D-Ring 1120 is substantially parallel to a sole of the shoe (or the ground upon which the shoe rests), and such that a curved portion of the first D-Ring 1120 is rotatable approximately 180 degrees from pointing upward to pointing downward, and such that the first D-Ring 1120 rests pointing substantially downward when not engaged by a resistance band. The second D-Ring 1121 may be disposed at the second juncture region 1126, such that a straight portion of the second D-Ring is disposed within a middle portion of the second juncture region 1126 and the straight portion of the second D-Ring 1121 is substantially parallel to a sole of the shoe (or the ground upon which the shoe rests), and such that a curved portion of the second D-Ring 1121 is rotatable approximately 180 degrees from pointing upward to pointing downward, and such that the second D-Ring 1121 rests pointing substantially downward when not engaged by a resistance band.

Figure 12:
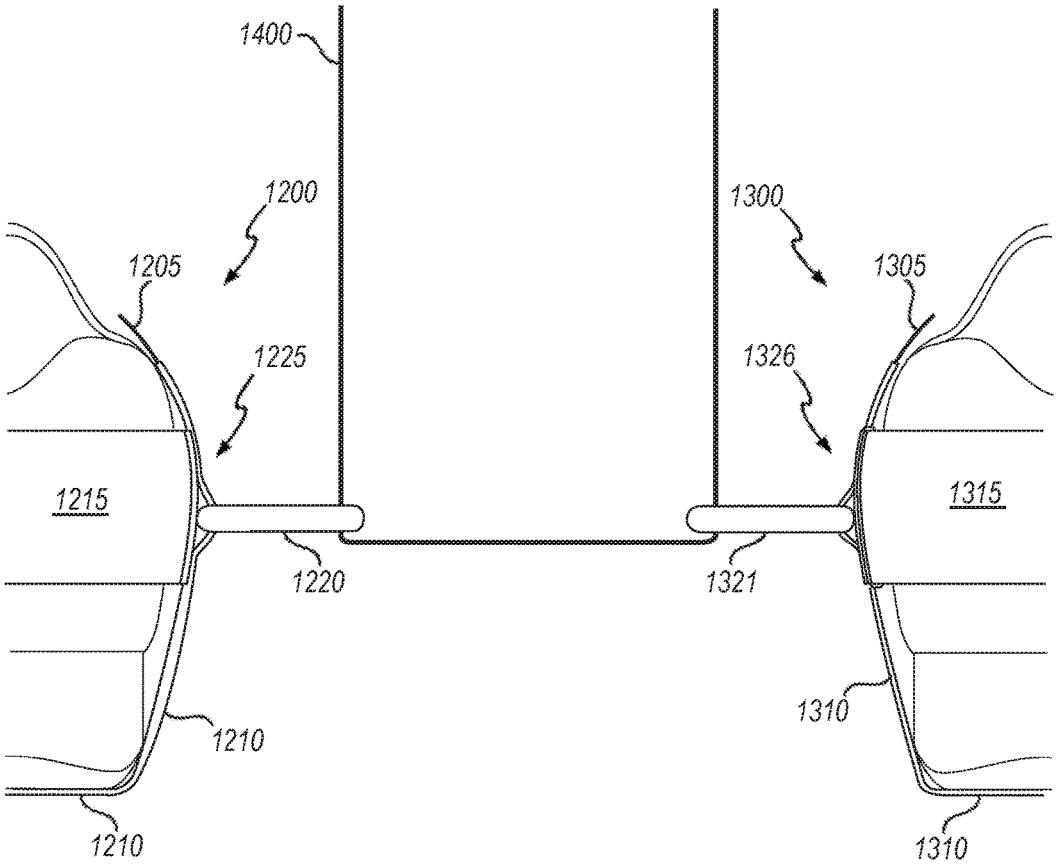
FIG. 12 is an illustration of a rear view of two shoe harnesses engaged with a resistance band.

FIG. 12 is an illustration of a rear view of two shoe harnesses engaged with a resistance band. As shown in FIG. 12, the user may don two shoe harnesses 1200, 1300, one on each shoe. The user may then engage a resistance band 1400 with the D-Ring 1220 and D-Ring 1321. D-Ring 1220 and D-Ring 1321 are preferably disposed within a middle portion of the juncture regions 1225, 1326, which are at the joining of the top strap 1205, 1305, heel strap 1215, 1315, and bottom strap 1210, 1310. As shown, the two D-Rings 1220, 1321 are preferably substantially parallel to the ground when engaged in this manner with the resistance band 1400. Preferably, the D-Rings 1220, 1321 are made of smooth metal that allows the cloth or plastic resistance band to slide against very low friction when the user wants to adjust her stance or exercise routine. Because the D-Rings 1220, 1321 are rotatable within the two juncture regions 1225, 1326, they are always in the appropriate position for allowing the resistance band to slide back and forth to allow the user to widen or narrow her stance.

Unless otherwise stated, all measurements, values, ratings, positions, magnitudes, sizes, locations, and other specifications that are set forth in this specification, including in the claims that follow, are approximate, not exact. They are intended to have a reasonable range that is consistent with the functions to which they relate and with what is customary in the art to which they pertain.

The foregoing description of the preferred embodiment has been presented for the purposes of illustration and description. While multiple embodiments are disclosed, still other embodiments will become apparent to those skilled in the art from the above detailed description. These embodiments are capable of modifications in various obvious aspects, all without departing from the spirit and scope of protection. Accordingly, the detailed description is to be regarded as illustrative in nature and not restrictive. Also, although not explicitly recited, one or more embodiments may be practiced in combination or conjunction with one another. Furthermore, the reference or non-reference to a particular embodiment shall not be interpreted to limit the scope of protection. It is intended that the scope of protection not be limited by this detailed description, but by the claims and the equivalents to the claims that are appended hereto.

Except as stated immediately above, nothing that has been stated or illustrated is intended or should be interpreted to cause a dedication of any component, step, feature, object, benefit, advantage, or equivalent, to the public, regardless of whether it is or is not recited in the claims.

We claim:

1. A foot harness for resistance exercises, comprising:

a top strap;

a bottom strap;

a heel strap;

a first D ring, which is D-shaped; and a second D ring, which is D-shaped;

wherein a first end of said top strap, a first end of said bottom strap, and a first end of said heel strap are joined at a first juncture region;

wherein a second end of said top strap, a second end of said bottom strap, and a second end of said heel strap are joined at a second juncture region;

wherein said top strap is adapted to engage with an upper portion of a shoe;

wherein said bottom strap is adapted to engage with a bottom portion of said shoe;

wherein said heel strap is adapted to engage with a rear upper portion of said shoe;

wherein said first D ring is disposed at said first juncture region, such that a straight portion of said first D ring is disposed within a middle portion of said first juncture region and said straight portion of said first D ring is substantially parallel to a sole of said shoe, and such that a curved portion of said first D ring is rotatable approximately 180 degrees from pointing upward to pointing downward, and such that said first D ring rests pointing downward when not engaged;

wherein said second D ring is disposed at said second juncture region, such that a straight portion of said second D ring is disposed within a middle portion of said second juncture region and said straight portion of said second D ring is substantially parallel to a sole of said shoe, and such that a curved portion of said second D ring is rotatable approximately 180 degrees from pointing upward to pointing downward, and such that said second D ring rests pointing downward when not engaged;

wherein said first junction region and said second junction region are positioned such that, when engaged with said shoe, they are on direct opposite sides of said shoe;

wherein said top strap comprises: a first top strap segment, a second top strap segment, and a first strap attachment and adjustment mechanism;

wherein one of said two top strap segments is longer than the other and they removably attach to each other via said first strap attachment and adjustment mechanism;

wherein said first strap attachment and adjustment mechanism is positioned adjacent to one of said two juncture regions;

wherein said heel strap comprises: a first heel strap segment, a second heel strap segment, and a second strap attachment and adjustment mechanism;

wherein one of said two heel strap segments is longer than the other and said two heel strap segments are adapted to removably attach to each other via said second strap attachment and adjustment mechanism;

wherein said second strap attachment and adjustment mechanism is positioned adjacent to one of said two juncture regions; and wherein said first strap attachment and adjustment mechanism and second strap attachment and adjustment mechanism adjust such that said top strap and said heel strap fit matingly on said shoe.

2. The foot harness of claim 1, further comprising:

a first indicia; and a second indicia.

3. The foot harness of claim 2, wherein said first strap attachment and adjustment mechanism is a cam buckle and said second strap attachment and adjustment mechanism is a cam buckle.

4. The foot harness of claim 3, wherein said first indicia is positioned within an inner surface of said bottom strap;

wherein said second indicia is positioned within an inner surface of said heel strap; and wherein said first indicia and said second indicia facilitate proper positioning of said foot.

5. The foot harness of claim 1, wherein said top strap, said bottom strap, and said heel strap are constructed of a webbing material.

6. The foot harness of claim 1, wherein a width of said top strap and a width of said heel strap is approximately 1 inch; and wherein said bottom strap is non-adjustable and has a width of approximately 1.5 inches.

7. The foot harness of claim 1, wherein said foot harness is adapted to hold and secure a fitness tracker wearable.

8. A foot harness for resistance exercises, comprising:

a top strap;

a bottom strap;

a heel strap;

a first D ring, which is D-shaped;

a second D ring, which is D-shaped;

a first indicia; and a second indicia;

wherein a first end of said top strap, a first end of said bottom strap, and a first end of said heel strap are joined at a first juncture region;

wherein a second end of said top strap, a second end of said bottom strap, and a second end of said heel strap are joined at a second juncture region;

wherein said top strap is adapted to engage with an upper portion of a shoe;

wherein said bottom strap is adapted to engage with a bottom portion of said shoe;

wherein said heel strap is adapted to engage with a rear upper portion of said shoe;

wherein said first D ring is disposed at said first juncture region, such that a straight portion of said first D ring is disposed within a middle portion of said first juncture region and said straight portion of said first D ring is substantially parallel to a sole of said shoe, and such that a curved portion of said first D ring is rotatable approximately 180 degrees from pointing upward to pointing downward, and such that said first D ring rests pointing downward when not engaged;

wherein said second D ring is disposed at said second juncture region, such that a straight portion of said second D ring is disposed within a middle portion of said second juncture region and said straight portion of said second D ring is substantially parallel to a sole of said, and such that a curved portion of said second D ring is rotatable approximately 180 degrees from pointing upward to pointing downward, and such that said second D ring rests pointing downward when not engaged;

wherein said first junction region and said second junction region are positioned such that they are on direct opposite sides of said shoe;

wherein said first indicia is positioned within an inner surface of said bottom strap;

wherein said second indicia is positioned within an inner surface of said heel strap;

wherein said first indicia and said second indicia facilitate proper positioning of said foot;

wherein said top strap comprises: a first top strap segment, a second top strap segment, and a first strap attachment and adjustment mechanism;

wherein one of said two top strap segments is longer than the other and they removably attach to each other via said first strap attachment and adjustment mechanism;

wherein said first strap attachment and adjustment mechanism is positioned adjacent to one of said two juncture regions;

wherein said heel strap comprises: a first heel strap segment, a second heel strap segment, and a second strap attachment and adjustment mechanism;

wherein one of said two heel strap segments is longer than the other and said two heel strap segments are adapted to removably attach to each other via said second strap attachment and adjustment mechanism;

wherein said second strap attachment and adjustment mechanism is positioned adjacent to one of said two juncture regions;

wherein said first strap attachment and adjustment mechanism and second strap attachment and adjustment mechanism adjust such that said top strap and said heel strap fit matingly on said shoe;

wherein said top strap, said bottom strap, and said heel strap are constructed of a webbing material;

wherein a width of said top strap and a width of said heel strap is approximately 1 inch;

wherein said bottom strap is non-adjustable and has a width of approximately 1.5 inches; and wherein said foot harness is adapted to hold and secure a fitness tracker wearable.

* * * * *